US008229289B2

(12) United States Patent
Schneider et al.

(10) Patent No.: US 8,229,289 B2
(45) Date of Patent: Jul. 24, 2012

(54) CONDENSATE DISCHARGE BY MEANS OF CONDENSATE EVAPORATION IN A COOLING DEVICE

(75) Inventors: Stefan Schneider, Bad Endbach-Battenhorn (DE); Joachim Maul, Ehringshausen (DE)

(73) Assignee: Rittal GmbH & Co. KG, Herborn (DE)

( * ) Notice: Subject to any disclaimer, the term of this patent is extended or adjusted under 35 U.S.C. 154(b) by 903 days.

(21) Appl. No.: 12/225,405

(22) PCT Filed: Jan. 27, 2007

(86) PCT No.: PCT/EP2007/000709

§ 371 (c)(1),
(2), (4) Date: Sep. 19, 2008

(87) PCT Pub. No.: WO2007/107198

PCT Pub. Date: Sep. 27, 2007

(65) Prior Publication Data

US 2011/0158615 A1 Jun. 30, 2011

(30) Foreign Application Priority Data

Mar. 21, 2006 (DE) ..... 10 2006 013 271

(51) Int. Cl.
*F22B 29/06* (2006.01)
*F25B 5/00* (2006.01)

(52) U.S. Cl. ..... 392/397; 62/283

(58) Field of Classification Search ..... 392/322, 392/324, 339, 340–345, 386, 694, 396–403, 392/478–484; 62/259.2, 259.4, 275, 276, 62/283

See application file for complete search history.

(56) References Cited

U.S. PATENT DOCUMENTS

| | | | | |
|---|---|---|---|---|
| 2,069,149 | A | 1/1937 | Hokanson | |
| 3,280,580 | A * | 10/1966 | Costantini et al. | 62/275 |
| 3,370,454 | A * | 2/1968 | Flores | 374/3 |
| 3,561,229 | A * | 2/1971 | Levin | 62/218 |
| 3,683,153 | A | 8/1972 | Heyer | |
| 4,001,548 | A * | 1/1977 | Bauer | 219/388 |
| 4,462,216 | A | 7/1984 | Kramer | |
| 6,442,341 | B1 * | 8/2002 | Wu | 392/479 |

FOREIGN PATENT DOCUMENTS

| | | |
|---|---|---|
| DE | 91 02 695.4 | 7/1991 |
| DE | 198 17 247 A1 | 10/1999 |
| DE | 299 06 950 U1 | 10/2000 |
| DE | 10 2005 062 616 A1 | 6/2007 |
| EP | 0 262 243 | 4/1988 |

(Continued)

*Primary Examiner* — Sang Paik
(74) *Attorney, Agent, or Firm* — Pauley Petersen & Erickson

(57) ABSTRACT

A condensate evaporator with an electrically heatable accommodation chamber for water of condensation which is produced in a cooling device and is to be evaporated. A design which is as compact and simple is achieved because the accommodation chamber is formed by a tube section on whose outer face at least one heating element which is in thermal contact with the tube section is arranged and at one end of which an inlet for the supplied water of condensation is arranged and at an other end of which an outlet for the steam which is produced from the water of condensation by the heating element is arranged. This invention also relates to a cooling device, in particular for a switchgear cabinet, having a condensate evaporator according to this invention.

44 Claims, 3 Drawing Sheets

FOREIGN PATENT DOCUMENTS

| | | | |
|---|---|---|---|
| EP | 0 521 181 | A1 | 1/1993 |
| EP | 0 573 691 | B1 | 12/1993 |
| EP | 1 801 514 | A1 | 6/2007 |
| JP | 58 122378 | | 7/1983 |
| JP | 09231454 | A | 9/1997 |
| JP | 10 047838 | | 2/1998 |
| JP | 2001 133129 | | 5/2001 |
| JP | 2001 147074 | | 5/2001 |
| JP | 2001 208461 | | 8/2001 |
| WO | 02/05688 | A1 | 1/2002 |
| WO | 2004/003420 | A1 | 1/2004 |

* cited by examiner

CONDENSATE DISCHARGE BY MEANS OF CONDENSATE EVAPORATION IN A COOLING DEVICE

BACKGROUND OF THE INVENTION

1. Field of the Invention

This invention relates to a cooling device, particularly a switchgear cabinet, having a cooling circuit which has an evaporator, a condenser and a compressor, in which condensation water generated is evaporated in a condensate-vaporizing device having an electrically heatable condensation water receiving chamber.

2. Discussion of Related Art

Known cooling devices are for example employed for air-conditioning switchgear cabinets, in which a number of electronic components are housed, which emit a considerable amount of dissipated energy in the form of heat. The condensation water created at the evaporator drips off and is caught in a condensate collecting vessel arranged underneath. It is known to feed the condensation water by a pump arrangement from the condensate collecting vessel to an electrically heated condensate-vaporizing device, in which the condensate evaporates and is dissipated to the environment in the form of water vapor.

Reaching a filling limit of the condensation water in the condensate collecting vessel is determined by a sensor arrangement, or a float-type switch, which switches the pump arrangement on and the heater in the condensate collecting vessel. As soon as the condensate level in the condensate collecting vessel drops below a predetermined fill level, the pump arrangement, as well as the heater in the condensate-vaporizing device, is shut off. This solution is very elaborate in a technical sense and thus cost expensive and also error-prone due to the complex construction. Also, such an arrangement takes up a relatively large structural volume.

A cooling device is known from German Patent Reference DE 198 17 247 A1, in connection with which a heating device is arranged in the condensate collecting vessel for vaporizing the condensation water, so that some type of a condensate-vaporizing device is created. Because of the limited structural space such condensate-vaporizing devices may only have small structural size, and the vaporizing output is small. When a large amount of condensate is accumulating, condensate runs off past a provided safety overflow and is discharged through a run-off hose into the environment. Undesired puddles can form on the ground here.

SUMMARY OF THE INVENTION

It is one object of this invention to provide a condensate removal by condensate evaporation, in particular in connection with a cooling device, by which resulting condensate can be removed with the least possible technical outlay by evaporation without the danger of puddle formation. Also, the condensate-vaporizing device should be constructed as compactly and simply as possible.

This object of this invention is attained with a condensate-vaporizing device having characteristics described in this specification and in the claims, and by a cooling device.

In connection with the condensate-vaporizing device in accordance with this invention, the receiving chamber for the condensation water to be evaporated is formed by a pipe section, on whose exterior at least one heating element is arranged, which is in thermal contact with the pipe section. An inlet for the fed-in condensation water is arranged at one end of the pipe section, and at the other end of the pipe section an outlet for the water vapor generated by the heating element from the condensation water.

The structure of the condensate-vaporizing device is simple. Only a few components are used, so that the manufacturing costs are low and there is functional dependability. With this condensate-evaporating device it is possible to completely evaporate condensation water introduced in to the receiving chamber, particularly if the heating element is continuously operated during operation of the cooling device. With these measures, it is possible to achieve condensation water entering the receiving chamber which is immediately heated and evaporated. No additional sensing arrangements for determining the level of fluids are required.

For preventing either condensation water or water vapor from being conducted back, or flashes back, through the condensation water inlet because water vapor is formed in the pipe section, it is possible to form an inlet labyrinth at the condensation water inlet, which has a downwardly open inlet opening below the condensation water level and a return flow blocking device for the condensation water to be evaporated, which is in the pipe section.

It is possible to omit the use of a pumping arrangement, because in a preferred embodiment, the downwardly open inlet opening is arranged in direct flow contact with a condensate collecting vessel and below the condensation water level of the condensation water present in the condensate collecting vessel. It is thus achieved that the condensation water flows into the pipe section because of gravity, wherein the amount of condensation water flowing into the pipe section is determined by the condensation water level in the condensate collecting vessel and by the return flow blocking device.

In accordance with one embodiment, the return flow blocking device can be formed by a wall section which projects vertically upward. Here, the wall section is inserted into the inlet labyrinth so that the inflowing condensation water can only flow over its upward pointing edge.

A water vapor outlet pipe section can be formed at the water vapor outlet at the end of the pipe section, which has an upwardly open outlet opening, to which an outlet pipe or outlet hose can be connected. This represents a particularly simple form of water vapor removal from the cooling device.

In accordance with one embodiment, the condensate-vaporizing device can have an evaporator unit, formed by an arrangement including at least the pipe section, the heating element and a heat-resistant and heat-conducting molded element. This molded element maintains the pipe section in a corresponding recess and also has a receptacle for the heating element.

To produce the evaporator unit in a particularly cost-effective manner, while still assuring the required heat resistance, or conducting capability, the molded element can be made of aluminum and can, in particular, be produced by an aluminum extrusion process.

To assure a particularly good heat transfer from the heating element to the condensation water in the pipe section, the pipe section can be designed as a metal pipe section. Particularly effective corrosion resistance is achieved if the pipe section is made of high-grade steel.

In a particularly simple and cost-effective embodiment, the pipe section can have a circular cross section. This also permits a particularly good heat transfer from the heating element to the condensation water to be evaporated.

In order to securely attach the condensate evaporator inside a cooling device, and also to be able to later retrofit an existing cooling device with a condensate evaporator in a simple manner, wherein the uncontrolled exit of condensation water and water vapor from the condensate evaporator is to be assuredly prevented, the evaporator unit can be arranged inside a closed, watertight housing.

In one embodiment, the housing can have a housing element which extends around the evaporator unit and parallel in relation to the pipe section. A cover can be respectively applied to the two open ends of the substantially hollow-cylindrical housing element. Thus, an inlet cover is arranged at the inlet end of the pipe section, and an outlet cover at the outlet side of the pipe section.

For achieving a fluid-proof connection between the pipe section end on the inlet side and the inlet cover, the end of the pipe section at the inlet side can extend into a corresponding through-opening formed in the inlet cover, wherein the inlet labyrinth is embodied on the exterior of the inlet cover facing away from the pipe section.

The technical production cost outlay can be minimized and the number of housing elements reduced if the inlet cover is a one-piece plastic injection-molded element with the housing element surrounding the evaporator unit, and if an approximately cup-shaped housing element for receiving the evaporator unit is formed. Also, the inlet cover can be embodied as a one-piece plastic injection-molded element together with the inlet labyrinth.

For achieving a fluid-proof connection between the pipe section end on the outlet side and the outlet cover, the end of the pipe section at the outlet side can extend into a corresponding through-opening formed in the outlet cover, wherein the water vapor outlet pipe section is on the exterior of the outlet cover facing away from the pipe section. The outlet cover can be embodied as a one-piece plastic injection-molded element together with the water vapor outlet pipe section.

A receptacle for the heating element is in the evaporation unit, which is open at least in the direction toward the inlet cover and/or in the direction toward the outlet cover for inserting the heating element when the housing or the housing covers is not yet attached. With the housing covers attached, the inlet cover or the outlet cover close off the respective receiving opening in the assembled state and secure the heating element.

For supplying the heating element with electric current, supply openings for supplying the heating element with electrical current can be formed in the inlet cover and/or the outlet cover.

In accordance with one embodiment which is easy to realize with production technology, the housing covers can be connected with the housing element surrounding the evaporator unit by ultrasonic welding.

The condensate evaporator in accordance with this invention can be used in connection with a cooling device, in particular for a switchgear cabinet, having a cooling circuit which has an evaporator, a condenser and a compressor. In accordance with one preferred embodiment, a condensate collecting vessel for collecting the condensation water being generated can be provided. In this embodiment, the condensate collecting vessel is in direct flow contact with the condensate-vaporizing device, so that the condensation water flows into the condensate-vaporizing device because of the effect of gravity. An additional conveying device, such as a pump, for example, can be omitted.

In order to not require long connecting lines between the condensate collecting vessel and the condensate evaporator, the condensate-vaporizing device can be arranged directly on the condensate collecting vessel. A more compact arrangement can be realized if the condensate-vaporizing device is arranged in or on the condensate collecting vessel, in which case the inlet opening of the inlet labyrinth is arranged in the condensation water and below the condensation water level.

To continuously evaporate the condensation water which is respectively generated during operation of the cooling device, and thus to reduce the creation of condensation water collections, which must be removed, the condensate-vaporizing device can be continuously heated at least during the operation of the cooling vessel.

BRIEF DESCRIPTION OF THE DRAWINGS

This invention is explained in greater detail in view of a preferred embodiment of a condensate-vaporizing device introduced into a cooling device, shown in the drawings, wherein.

DETAILED DESCRIPTION OF THE INVENTION

Figure 1:
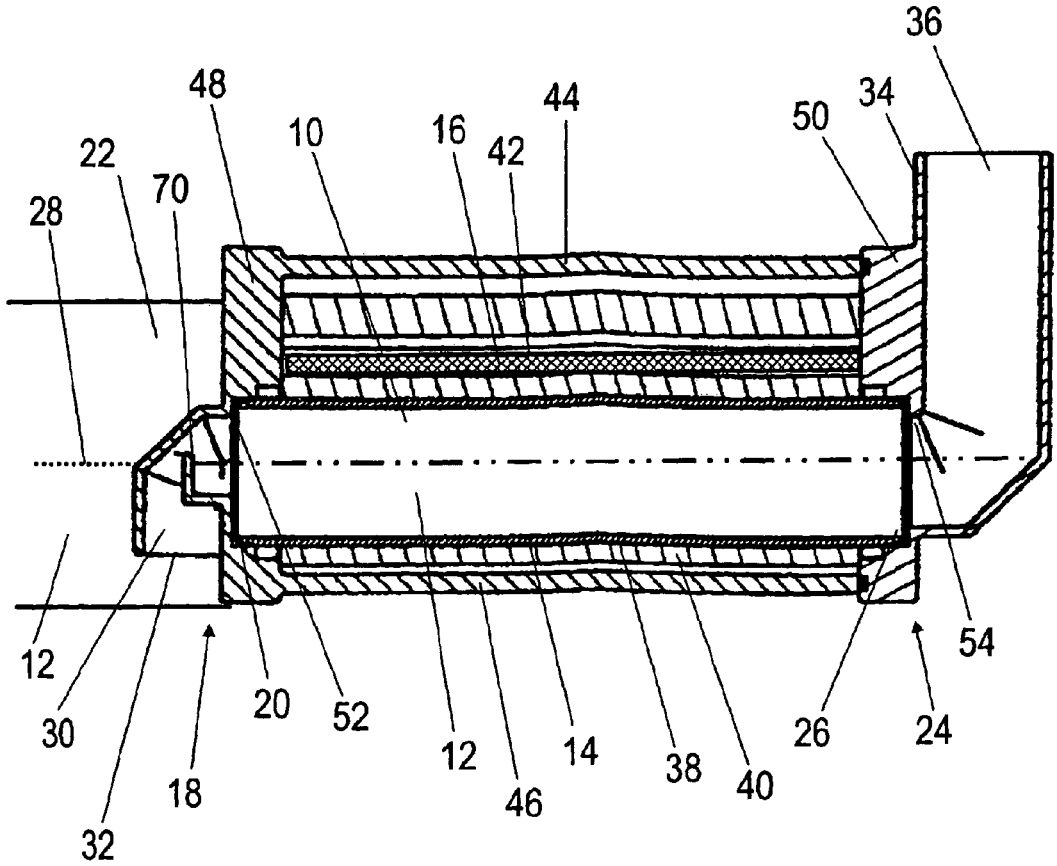
FIG. 1 shows a schematic sectional lateral view of a condensate-vaporizing device arranged directly on a condensate collecting vessel of a cooling device.

In a schematic lateral view and in section, FIG. 1 shows a condensate-vaporizing device in accordance with this invention, which is arranged directly on a condensate collecting vessel 22 of a cooling device, not shown in detail, for a switchgear cabinet. The cooling device has a cooling circuit with an evaporator, a condenser and a compressor. The condensation water 12 generated in the cooling device is collected in the condensate collecting vessel 22.

Figure 2:
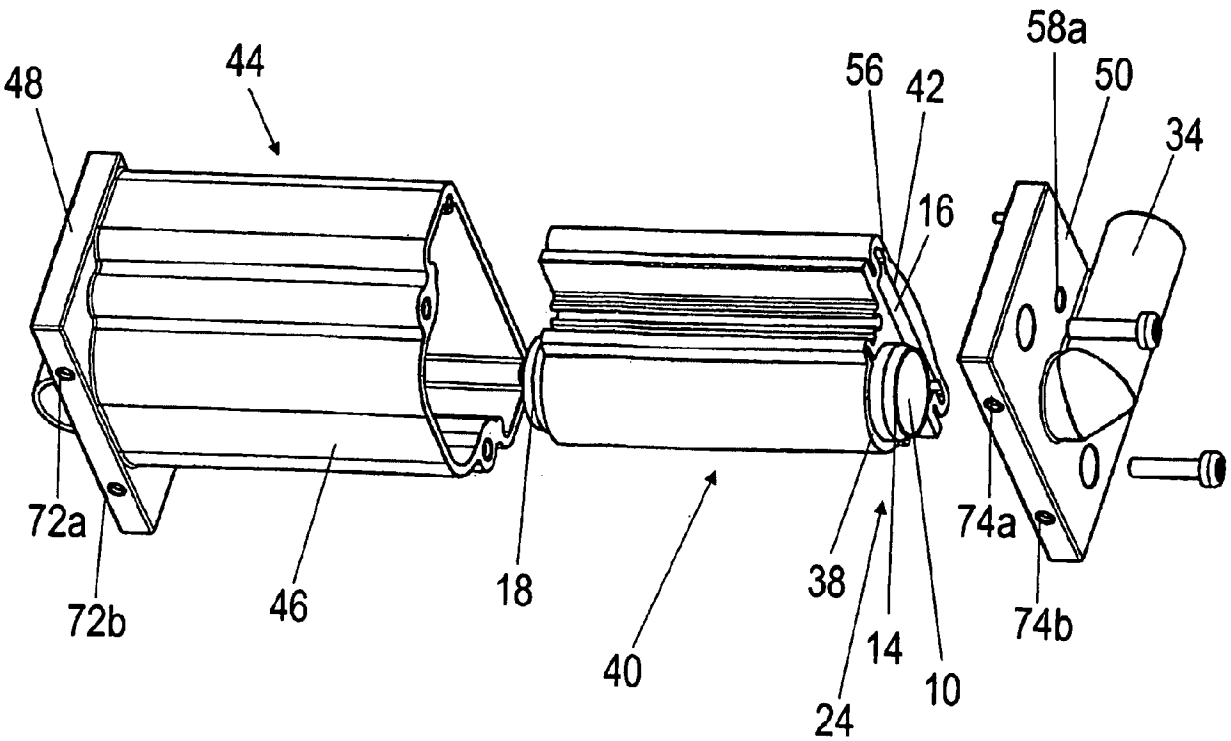
FIG. 2 shows the condensate-vaporizing device in accordance with FIG. 1, in a perspective exploded view.

In a non-represented embodiment, the condensate collecting vessel can also be connected with the condensate-vaporizing device via a pipeline or hose. In accordance with a further non-represented embodiment, the condensation water created can also be fed directly to the condensate-vaporizing device, such as where no condensate collecting vessel within the meaning of FIG. 2 is provided.

The condensation water 12 flows into the condensate-vaporizing device via an inlet opening 32, which is in direct contact with the condensation water 12 collected in the condensate collecting vessel 22 and is arranged below the condensation water level 28.

The condensate-vaporizing device has a receiving chamber 10, which can be electrically heated, for the condensation water 12 to be evaporated. The receiving chamber 10 is formed by a pipe section 14, made of high-grade steel, which extends horizontally through FIG. 1, on whose exterior a PTC heating element 16 is arranged above the pipe section 14, extends parallel with and is in thermal contact with the pipe section 14. An inlet 20 for the condensation water 12 supplied from the condensate collecting vessel 22 is at an end 18 of the pipe section 14, and an outlet 26 for the water vapor generated from the condensation water at the other end 24.

The PTC heating element 16 is continuously provided with a voltage during the operation of the cooling device, or as long as condensation water is created in it. During this the PTC heating element generates a constant surface temperature of approximately 220° C. This temperature is sufficient for heating the condensation water in the pipe section 14, and to evaporate it.

An inlet labyrinth 30 is formed in the condensation water inlet 20, which has a downwardly open inlet opening 32 and a return flow blocking device for the condensation water 12 to be evaporated and present in the pipe section 14. Because of the effect of gravity, the condensation water flows into the pipe section 14, wherein the amount of condensation water 12 flowing into the pipe section is determined by the condensation water level 28 in the condensate collecting vessel 22 and by the return flow blocking device. The return flow blocking device is formed by a wall section 70, which projects vertically upward, wherein the wall section 70 is inserted into the inlet labyrinth 30 so that the inflowing condensation water can only flow over it at its upward pointing edge. In its lower area, the wall section 70 is sealingly connected with the inlet labyrinth 30.

The water vapor generated in the heated pipe section 14 exits from the water vapor outlet 26 located opposite the condensate inlet 20 and shown in FIG. 1 on the right side of the pipe section 14. A water vapor outlet pipe section 34 is formed on the water vapor outlet 26 and has an upwardly open outlet opening 36, to which an outlet pipe or an outlet hose can be connected.

FIG. 2 shows the condensate-vaporizing device in accordance with FIG. 1 in a perspective exploded view. The condensate-vaporizing device is surrounded by a closed, water-tight housing 44, shown in FIG. 2 in the opened state during mounting, so that the interior construction of the condensate-vaporizing device in particular also becomes clear.

The pipe section 14 has a circular cross section and is maintained inside a heat-resistant and heat-conducting molded element 40. This molded element 40 is made from aluminum by extrusion.

A substantially cylinder-shaped recess 38 is in the molded element 40 and corresponds with the circular exterior cross section of the pipe section 14. The pipe section 14 is pressed into the recess 38.

The molded element 40 has an approximately rectangular receptacle 42 for the PTC heating element 16, which is arranged above the pipe section 14 and extends parallel with respect to it. The arrangement of the pipe section 14, the heating element 16 and the molded element 40 forms a unit which can be called an evaporation unit 14, 16, 40.

The housing 44 has a housing element 46, which surrounds the evaporation unit 14, 16, 40 and extends parallel with respect to the pipe section 14. In inlet cover 48, which is produced as a one-piece plastic injection-molded element together with the housing element 46 surrounding the evaporation unit 14, 16, 40, is arranged on the housing element 46 at the end 18 on the inlet side of the pipe section 14. As FIG. 2 shows, an approximately cup-shaped housing element 46, 48 for receiving the evaporation unit 14, 16, 40 is thus created.

An outlet cover 50 can be mounted at the outlet end 24 of the pipe section 14. In the unassembled state, the receptacle 42 for the PTC heating element is open in the direction toward the outlet cover 50 so that the PTC heating element can be inserted. Then, in the assembled state, the outlet cover 50 closes the receptacle opening 56 and maintains the heating element 16 in position.

In the assembled state, the inlet cover 48 and the outlet cover 50, together with the housing element 46, form the closed housing 44.

In view of FIG. 1, it is clear that the end 18 at the inlet side of the pipe section 14 extends into a corresponding through-opening 52 formed in the inlet cover 48 and ends with it in a fluid-tight manner. The inlet labyrinth 39 is attached to the exterior of the inlet cover 46 facing away from the pipe section 14. The inlet cover 48 is embodied as a one-piece plastic injection-molded element together with the inlet labyrinth 30.

The end 24 at the outlet side of the pipe section 14 extends into a corresponding through-opening 54 formed in the outlet cover 50 and ends with it in a fluid-tight manner. The water vapor outlet pipe section 34 is attached to the exterior of the outlet cover 50 facing away from the pipe section 14. The outlet cover 50 is formed as a one-piece plastic injection-molded element together with the water vapor outlet pipe section 34.

As FIG. 2 shows, supply openings 58*a* and 58*b* for electrical current supply lines for the heating element 16 are formed in the outlet cover 50.

The inlet cover 48 and the outlet cover 50 are connected by ultrasonic welding with the housing element 46 surrounding the evaporation unit 14, 16, 40.

For mounting the condensate-vaporizing device on a mounting plate or mounting holder of a switchgear cabinet or cooling device, respectively two threaded bores 72*a* and 72*b*, or 74*a* and 74*b*, which are open toward the bottom and extend vertically with respect to the pipe section 14, are provided in the inlet cover 48 and in the outlet cover 50. Threaded screws can be screwed into the threaded bores.

In accordance with another embodiment, tabs are formed on or attached to the inlet cover 48 and to the outlet cover 50, which are used for fastening the condensate-vaporizing device to a mounting plate or mounting holder of a switchgear cabinet or a cooling device. It is thus possible to provide threaded bores in the tabs.

Figure 3:
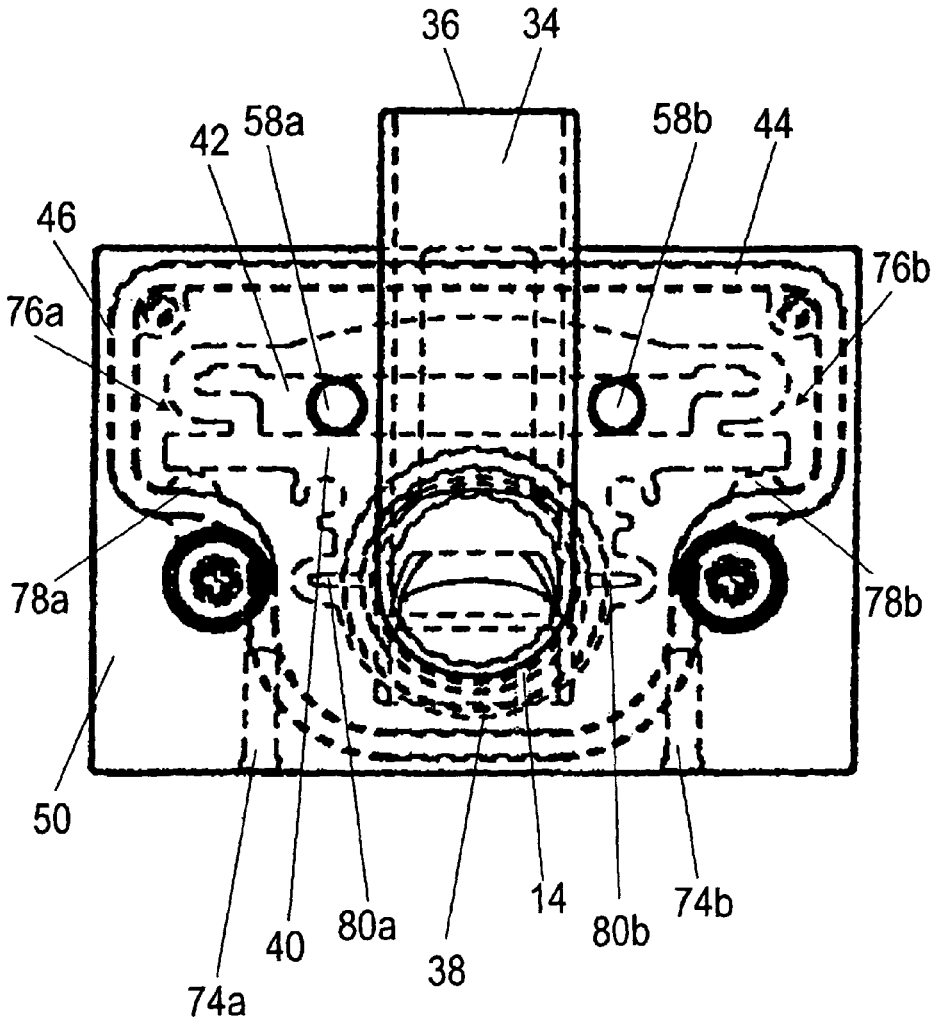
FIG. 3 shows the condensate-vaporizing device in accordance with FIGS. 1 and 2 in a transparent representation and on the outlet cover from above.

In a transparency representation and view from above on the outlet cover 50, FIG. 3 represents the condensate-vaporizing device shown in FIGS. 1 and 2. The installed position of the molded element 40 inside the housing 44, or of the housing element 45 surrounding the molded element 40, can be clearly seen by FIG. 3 in particular. For assuming a positionally secure seating of the molded element 40 inside the housing element 46, the housing element 40 rests with its left and right lateral areas 76*a* and 76*b* on a left and right support 78*a* and 78*b* formed on the interior wall of the housing element 46.

The pipe section 14 is maintained in the cylinder-shaped recess 38 inside the molded element 40. The recess 38 in the molded element 40 has a substantially circular cross section, on which respectively right and left lateral areas an expansion cut 80*a* or 80*b* is formed. The expansion cuts 80*a* and 80*b* prevent the molded element 40 from tearing while pressing the high-grade steel pipe section 14 into the recess 38, or assure the pressure force required for the stable holding of the pipe section 14 in the recess 38.

The condensate-vaporizing device represented in FIGS. 1 to 3 can be installed in accordance with this invention in a cooling device, in particular for a switchgear cabinet.

The invention claimed is:

1. A condensate-vaporizing device having an electrically heatable receiving chamber (10) for a condensation water (12) created in a cooling device and to be evaporated, in which the receiving chamber (10) is formed by a pipe section (14) on an exterior of which at least one heating element (16) is arranged and in thermal contact with the pipe section (14) and at which one end (18) an inlet (20) for the fed-in condensation water (12) is arranged, and at an other end (24) an outlet (26) for the water vapor generated by the heating element (16) from the condensation water is arranged, the condensate-vaporizing device comprising:

an inlet labyrinth (30) formed at the condensation water inlet (20) which has a downwardly open inlet opening (32) and a return flow blocking device for the condensation water (12) present in the pipe section (14) and which is to be evaporated, and the downwardly open inlet opening (32) arranged in direct flow contact with a condensate collecting vessel (22) and below the condensation water level (28) of the condensation water present in the condensate collecting vessel (22) so that the condensation water (12) flows into the pipe section (14) by gravity.

2. The condensate-vaporizing device in accordance with claim 1, wherein the return flow blocking device (34) is formed by a wall section which projects vertically upward, wherein the wall section is inserted into an inlet labyrinth so that the inflowing condensation water can only flow over an upward pointing edge.

3. The condensate-vaporizing device in accordance with claim 2, wherein a water vapor outlet pipe section (34) is formed at the water vapor outlet (26) which has an upwardly open outlet opening (36) to which an outlet pipe or an outlet hose is connectible.

4. The condensate-vaporizing device in accordance with claim 3, wherein the pipe section (14) is maintained in a corresponding recess (38) inside a heat-resistant and heat-conducting molded element (40), and the molded element (40) has a receptacle (42) for the heating element (16), wherein an arrangement of the pipe section (14), the heating element (16) and the molded element (40) forms an evaporation unit (14, 16, 40).

5. The condensate-vaporizing device in accordance with claim 4, wherein the heating element (16) extends parallel with the pipe section (14).

6. The condensate-vaporizing device in accordance with claim 5, wherein the heating element (16) is a PTC heating element.

7. The condensate-vaporizing device in accordance with claim 6, wherein the heating element (16) is continuously provided with a voltage.

8. The condensate-vaporizing device in accordance with claim 7, wherein the molded element (40) is made of an aluminum and is an extruded element.

9. The condensate-vaporizing device in accordance with claim 8, wherein the pipe section (14) is a metal pipe section.

10. The condensate-vaporizing device in accordance with claim 9, wherein the pipe section (14) has a circular cross section.

11. The condensate-vaporizing device in accordance with claim 10, wherein the evaporation unit (14, 16, 40) is arranged inside a closed watertight housing (44).

12. The condensate-vaporizing device in accordance with claim 11, wherein the housing (44) has a housing element (46) which extends around the evaporator unit (14, 60, 40) and parallel with respect to the pipe section (14), an inlet cover (48) arranged at an inlet end (18) of the pipe section (14), and an outlet cover (50) at an outlet end (24) of the pipe section (14).

13. The condensate-vaporizing device in accordance with claim 12, wherein the end (18) of the pipe section (14) at the inlet side extends into a corresponding through-opening (52) formed in the inlet cover (48) and ends in a fluid-tight manner, wherein the inlet labyrinth (39) is attached to an exterior of the inlet cover (48) facing away from the pipe section (14).

14. The condensate-vaporizing device in accordance with claim 13, wherein the inlet cover (48) together with the housing element (46) surrounding the evaporator unit (14, 16, 40) is a one-piece plastic injection-molded element and forms a cup-shaped housing element for receiving the evaporator unit (14, 16, 40).

15. The condensate-vaporizing device in accordance with claim 14, wherein the inlet cover (48) is a one-piece plastic injection-molded element together with the inlet labyrinth.

16. The condensate-vaporizing device in accordance with claim 15, wherein the end (24) of the pipe section (14) at the outlet side extends into a corresponding through-opening (54) formed in the outlet cover (50) and ends in a fluid-tight manner, and the water vapor outlet pipe section (34) is attached to the exterior of the outlet cover (50) facing away from the pipe section (14).

17. The condensate-vaporizing device in accordance with claim 16, wherein the outlet cover (50) is a one-piece plastic injection-molded element together with the water vapor outlet pipe section (34).

18. The condensate-vaporizing device in accordance with claim 17, wherein the receptacle (42) for the heating element (16) in the evaporation unit (14, 16, 40) is open at least in a first direction toward the inlet cover (48) or a second direction toward the outlet cover (50) for inserting the heating element (16), wherein at least one of the inlet cover (48) and the outlet cover (50) close off the receiving opening (56) in the assembled state and secure the heating element (16).

19. The condensate-vaporizing device in accordance with claim 18, wherein supply openings (58*a*, 58*b*) for supplying the heating element (16) with electrical current are formed in at least one of the inlet cover (48) and the outlet cover (50).

20. The condensate-vaporizing device in accordance with claim 19, wherein at least one of the inlet cover (48) and the outlet cover (50) is connectible with the housing element (46) surrounding the evaporator unit (14, 16, 40) by an ultrasonic weld.

21. The condensate-vaporizing device in accordance with claim 20, wherein a cooling device for a switchgear cabinet having a cooling circuit containing an evaporator, a condenser and a compressor, has the condensation water (12) that can be introduced into the condensate-vaporizing device.

22. The condensate-vaporizing device in accordance with claim 21, wherein a condensate collecting vessel (22) collects condensation water being created, the condensate-vaporizing device is in direct flow contact with the condensate collecting vessel (22), and the condensation water (12) flows into the condensate-vaporizing device by gravity.

23. The condensate-vaporizing device in accordance with claim 22, wherein the condensate-vaporizing device is arranged directly on the condensate collecting vessel (22).

24. The condensate-vaporizing device in accordance with claim 23, wherein the condensate-vaporizing device is arranged in or on the condensate collecting vessel (22), the inlet opening (22) of the inlet labyrinth is arranged in the condensation water and below the condensation water level (28).

25. The condensate-vaporizing device in accordance with claim 24, wherein the condensate-vaporizing device is continuously heated at least during an operation of the cooling device.

26. The condensate-vaporizing device in accordance with claim 1, wherein a water vapor outlet pipe section (34) is formed at the water vapor outlet (26) which has an upwardly open outlet opening (36) to which an outlet pipe or an outlet hose is connectible.

27. The condensate-vaporizing device in accordance with claim 1, wherein the pipe section (14) is maintained in a corresponding recess (38) inside a heat-resistant and heat-conducting molded element (40), and the molded element (40) has a receptacle (42) for the heating element (16), wherein an arrangement of the pipe section (14), the heating element (16) and the molded element (40) forms an evaporation unit (14, 16, 40).

28. The condensate-vaporizing device in accordance with claim 1, wherein the heating element (16) extends parallel with the pipe section (14).

29. The condensate-vaporizing device in accordance with claim 1, wherein the heating element (16) is a PTC heating element.

30. The condensate-vaporizing device in accordance with claim 1, wherein the heating element (16) is continuously provided with a voltage.

31. The condensate-vaporizing device in accordance with claim 1, wherein the molded element (40) is made of an aluminum and is an extruded element.

32. The condensate-vaporizing device in accordance with claim 1, wherein the pipe section (14) is a metal pipe section.

33. The condensate-vaporizing device in accordance with claim 1, wherein the pipe section (14) has a circular cross section.

34. The condensate-vaporizing device in accordance with claim 1, wherein a cooling device for a switchgear cabinet having a cooling circuit containing an evaporator, a condenser and a compressor, has the condensation water (12) that can be introduced into the condensate-vaporizing device.

35. The condensate-vaporizing device in accordance with claim 4, wherein the housing (44) has a housing element (46) which extends around the evaporator unit (14, 60, 40) and parallel with respect to the pipe section (14), an inlet cover (48) arranged at an inlet end (18) of the pipe section (14), and an outlet cover (50) at an outlet end (24) of the pipe section (14).

36. The condensate-vaporizing device in accordance with claim 4, wherein the receptacle (42) for the heating element (16) in the evaporation unit (14, 16, 40) is open at least in a first direction toward the inlet cover (48) or a second direction toward the outlet cover (50) for inserting the heating element (16), wherein at least one of the inlet cover (48) and the outlet cover (50) close off the receiving opening (56) in the assembled state and secure the heating element (16).

37. The condensate-vaporizing device in accordance with claim 6, wherein the evaporation unit (14, 16, 40) is arranged inside a closed watertight housing (44).

38. The condensate-vaporizing device in accordance with claim 12, wherein the inlet cover (48) together with the housing element (46) surrounding the evaporator unit (14, 16, 40) is a one-piece plastic injection-molded element and forms a cup-shaped housing element for receiving the evaporator unit (14, 16, 40).

39. The condensate-vaporizing device in accordance with claim 12, wherein the inlet cover (48) is a one-piece plastic injection-molded element together with the inlet labyrinth.

40. The condensate-vaporizing device in accordance with claim 12, wherein the end (24) of the pipe section (14) at the outlet side extends into a corresponding through-opening (54) formed in the outlet cover (50) and ends in a fluid-tight manner, and the water vapor outlet pipe section (34) is attached to the exterior of the outlet cover (50) facing away from the pipe section (14).

41. The condensate-vaporizing device in accordance with claim 12, wherein the outlet cover (50) is a one-piece plastic injection-molded element together with the water vapor outlet pipe section (34).

42. The condensate-vaporizing device in accordance with claim 12, wherein supply openings (58*a*, 58*b*) for supplying the heating element (16) with electrical current are formed in at least one of the inlet cover (48) and the outlet cover (50).

43. The condensate-vaporizing device in accordance with claim 12, wherein at least one of the inlet cover (48) and the outlet cover (50) is connectible with the housing element (46) surrounding the evaporator unit (14, 16, 40) by an ultrasonic weld.

44. The condensate-vaporizing device in accordance with claim 21, wherein the condensate-vaporizing device is continuously heated at least during an operation of the cooling device.

* * * * *